United States Patent [19]

Iritani et al.

[11] 4,397,632

[45] Aug. 9, 1983

[54] VAPORIZED TYPE LIQUID FUEL COMBUSTION APPARATUS

[75] Inventors: Koji Iritani; Akihiro Otsuka, both of Kawagoe, Japan

[73] Assignee: Sun Pot Kabushiki Kaisha, Saitama, Japan

[21] Appl. No.: 291,912

[22] Filed: Aug. 11, 1981

[30] Foreign Application Priority Data

| | | | |
|---|---|---|---|
| Sep. 9, 1980 | [JP] | Japan | 55-127273 |
| Sep. 9, 1980 | [JP] | Japan | 55-127274 |
| Oct. 3, 1980 | [JP] | Japan | 55-140466 |
| Feb. 20, 1981 | [JP] | Japan | 56-22122 |
| Feb. 20, 1981 | [JP] | Japan | 56-22123 |
| Mar. 14, 1981 | [JP] | Japan | 56-34829 |

[51] Int. Cl.[3] ..... F23D 11/44

[52] U.S. Cl. ..... 431/210; 431/218; 431/220; 431/226

[58] Field of Search ..... 431/208, 210–212, 431/218, 220, 222, 226, 333

[56] References Cited

U.S. PATENT DOCUMENTS

| | | | |
|---|---|---|---|
| 1,647,732 | 11/1927 | Hutchison | 431/220 |
| 2,398,883 | 4/1946 | Clarkson | 431/210 |

*Primary Examiner*—Carroll B. Dority, Jr.

*Attorney, Agent, or Firm*—Armstrong, Nikaido, Marmelstein & Kubovcik

[57] ABSTRACT

A vaporizing type liquid fuel combustion apparatus comprising a pot burner, vaporizer for vaporizing liquid fuel provided above the pot burner, a fuel supply pipe for supplying the liquid fuel to the vaporizer, a vaporized gas combustion burner which has a gas chamber connected to the vaporizer and which is arranged to heat the vaporizer, and a blower for supplying air to the pot burner and the vaporized gas combustion burner.

11 Claims, 12 Drawing Figures

VAPORIZED TYPE LIQUID FUEL COMBUSTION APPARATUS

BACKGROUND OF THE INVENTION

This invention relates to a combustion apparatus for vaporizing and burning liquid fuel, especially, kerosene.

Certain devices for vaporizing and burning kerosene have been known in the prior art. The difficulty generally encountered in burning kerosene is in vaporizing it.

A first general type of prior art device utilizes an electric heater to vaporize the fuel. The vapors are thereafter, mixed with air driven by a forced air blower.

A second general type utilizes a rotating scattering member to spread the fuel against the wall of a rotary evaporator.

The fuel scattered from a peripheral edge portion of the rotary evaporator is ignited for being burned. Thereafter, the evaporator is heated by the resultant combustion heat thereof and, thus, the fuel on the evaporator is vaporized to be burned.

The first type, however, is inconvenient in that it requires a large-size electric heater for vaporizing the fuel and the heater is required to be operated at all times during the operation of the combustion apparatus. The second type is inconvenient in that it requires the various rotary parts such as the rotating scattering member, the rotary evaporator and associated others, so that not only the entire construction thereof becomes complicated but also those rotary parts are liable to cause trouble.

OBJECTS AND SUMMARY OF THE INVENTION

The present invention has as an object the provision of a combustion apparatus for vaporizing and burning liquid fuel which does not require a large-size electric heater.

It is another object to provide an apparatus which does not require an electric heater to be operated at all times during the operation of the combustion apparatus.

It is a further object to provide an apparatus with a minimum of rotating parts.

It is still a further object to provide an apparatus which is simple to manufacture and operate.

The above objects and others which will be readily apparent to those skilled in the art are attained in a vaporizing type liquid fuel combustion apparatus which comprises a pot burner, vaporizer means for vaporizing required fuel provided above the pot burner, a fuel supply pipe for supplying the liquid fuel to the vaporizer means, a vaporized gas combustion burner which has a gas chamber connected to the vaporizer means and which is arranged to heat the vaporizer means, and a blower for supplying air to the pot burner and the vaporized gas combustion burner.

It is preferred that the vaporized means has a bottom portion formed as an inclined surface inclined in one direction having an upper end side and a lower end side, and the liquid fuel supply pipe is arranged to open on the upper end side of the inclined surface; and the lower end side of the inclined surface and the pot burner are in communication one with another through a connecting pipe.

The pot burner can be circular in form; the vaporizer means can be drum shaped; and the vaporized gas combustion burner can be circular annular in form.

Alternatively, the pot burner can be rectangular in form with the vaporizer means long tubular in form and with the vaporized gas combustion burner rectangular annular in form.

In the second embodiment, the vaporized gas combustion burner can comprise an inner wall member formed into an approximately U-shaped frame by a press forming of a heat resistant metal sheet having a large number of flame openings made in both side walls thereof, an outer wall member formed into an approximately U-shaped frame by a press forming of a heat resistant metal sheet having a swelled portion and a peripheral margin for welding, and a closure plate attached to an open end of the inner wall member; said outer wall member being put on the outer surface of said inner wall member and seam-welded together, said swelled portion being gradually decreased in its swelled amount towards the open end thereof, and said closure plate and an opposite end plate of the inner wall member are provided with attaching openings for attaching the vaporizer means.

The vaporizer means can be divided in its interior by a baffle plate into a vaporizing section for vaporizing the fuel and a mixing section, and the bottom portion of the pot burner is inclined so that fuel may be gathered on an ignition heater side of the pot burner.

The pot burner can be provided with ventilation openings made in both side walls thereof, and is provided at its center with an upright plate extending in the longitudinal direction thereof, and a fuel supply opening and an ignition heater are exposed to face one end portion of the upright plate, and windbreak members are provided on both sides of the ignition heater, and the pot burner is provided at its end portion with a ventilation opening for generating an air current flowing along the upright plate.

The apparatus can further comprise a fuel supply amount adjusting knob, and an inlet opening or an outlet opening of the blower is provided with a stationary air amount throttle plate, a movable air amount throttle plate put thereon and arranged to be rotatable with the rotation of the adjusting knob, and a throttle amount adjusting plate arranged to be rotatable with the rotation of the air amount throttle plate.

The adjusting knob can be axially movable on an operation shaft and ignition switch is provided behind and in opposition to a fuel supply amount maximum rotary angular position of the adjusting knob, and an extinguishing switch is provided behind and in opposite to a fuel supply amount minimum rotary angular position of the knob.

The fuel supply pipe can be provided with a diverged passage for supplying fuel directly to the pot burner, and the fuel supply pipe and the diverged passage are provided with respective electromagnetic valves interposed therein.

Some embodying examples of this invention will now be explained with reference to the accompanying drawings.

DETAILED DESCRIPTION OF PREFERRED EMBODIMENTS

Figure 1:
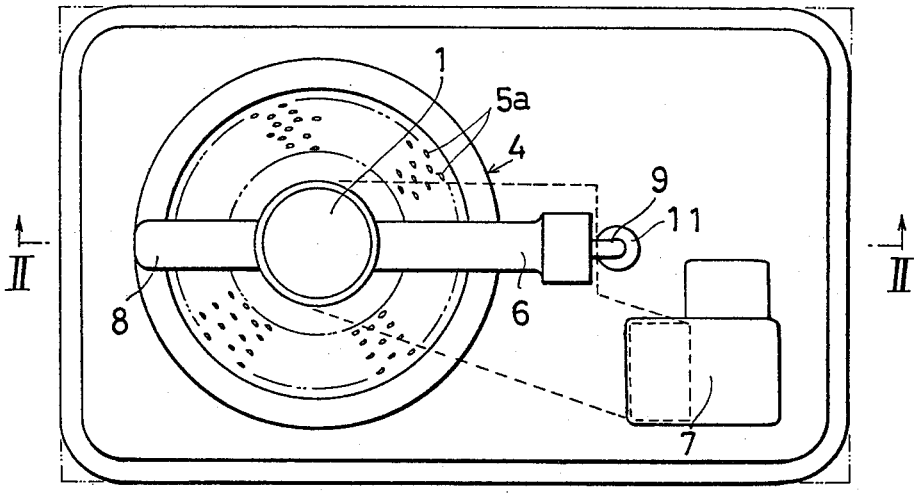
FIG. 1 is a top plan view of one embodiment of this invention apparatus.

Referring to the drawings, a pot burner 2 is provided below a vaporizer 1 for heating the same. An ignition electric heater 3 such as a ceramic heater or the like is provided on the pot burner 2. A vaporized gas combustion burner 4 is provided above the pot burner 2 having a gas chamber 5 which is in communication with the vaporizer 1. The vaporizer 1 is also connected at its one end to a blower 7 through a duct 6 and is in communication at its other end with the foregoing gas chamber 5 through a duct 8. The duct 6 is diverged to make a communication between the blower 7 and the pot burner 2.

Figure 2:
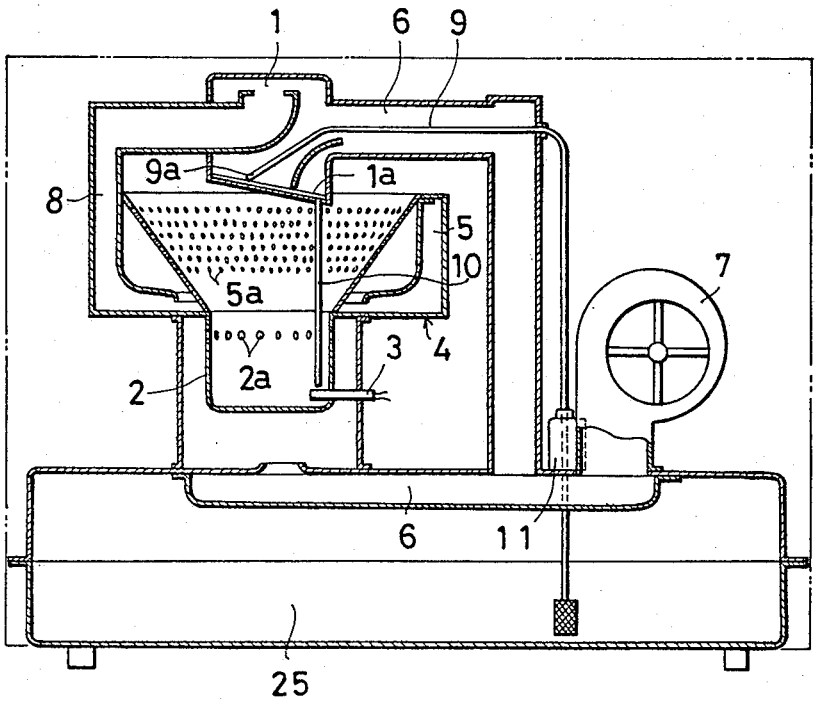
FIG. 2 is a sectional view taken along the line II—II in FIG. 1.

In the example shown in FIGS. 1 and 2, the vaporized gas combustion burner 4 is formed into a circular annular shape extending along a circular top edge portion of an open peripheral edge of the pot burner 2 of a cylindrical form. The circumferential inner wall of burner 4 is frusto-conical in form. A large number of flame openings 5*a* are made therein. The vaporizer 1 is in the form of a drum, and is so provided as to be positioned above the center of the pot burner 2 and the vaporized gas combustion burner 4.

Figure 3:
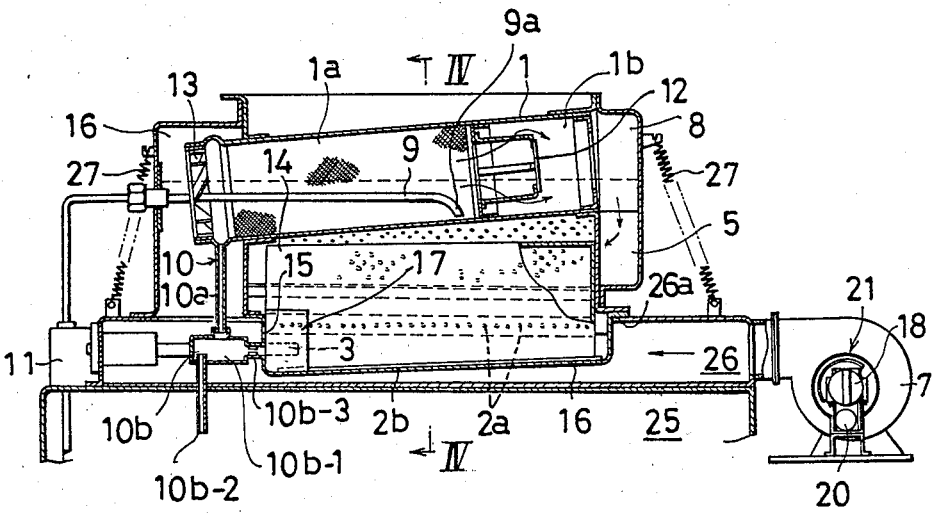
FIG. 3 is a sectional side view of another embodiment of this invention apparatus.
Figure 4:
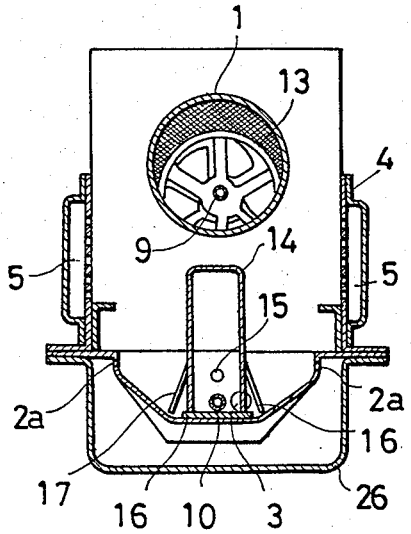
FIG. 4 is a sectional view taken along the line IV—IV in FIG. 3.

The vaporized gas combustion burner 4 may be modified in form to be of a rectangular annular form as shown in FIGS. 3 and 4. In this case, the pot burner 2 is rectangular in form, and the vaporizer 1 is tubular in form. An inner surface of the cylindrical vaporizer 1 has a cylindrical net liner.

In any of these examples, the bottom portion of the vaporizer 1 is formed into a gradually inclined surface and a fuel supply pipe 9 is arranged to be open at its front end opening 9*a* on an upper end side of the inclined surface of the vaporizer 1. The lower end side of the surface of vaporizer 1 is in communication through a connecting pipe 10 with the ignition electric heater 3 provided on the pot burner 2. The vaporizer 1 is connected to the blower 7. In the case of the vaporizer 1 of the drum form as shown in FIGS. 1 and 2, it is preferable that the bottom portion thereof be provided with a guide groove 1*a* for guiding fuel supplied from the fuel supply pipe 9 towards the connecting pipe 10 side. Referring to the drawings, an electromagnetic pump 11 is interposed in the supply pipe 9. A large number of ventilation openings 2*a* are made in the pot burner 2.

The operation of the foregoing apparatus is as follows:

If, under the condition that the ignition heater 3 is energized and the vaporizer 1 is in its cold condition, the electromagnetic pump 11 interposed in the fuel supply pipe 9 is operated to supply fuel to the vaporizer 1. The fuel flows along the inclined surface of the vaporizer 1 and is introduced into the pot burner 2 through the connecting pipe 10. At that time, the fuel is brought into contact with the energized ignition heater 3 and is burned in the pot burner 2. As this burning is continued, the vaporizer 1 is heated by the combustion heat thereof. The fuel in the vaporizer 1 begins to be vaporized, and the resultant vapor is mixed with the air forcedly supplied from the blower 7. The gas mixture is supplied to the gas chamber 5 of the burner 4 and gushes out of a large number of the flame openings 5*a*, and consequently the same is ignited by the flames of the combustion in the pot burner 2 and thus is burned.

When all of the fuel which is being supplied to the vaporizer 1 is vaporized, no fuel remains to be supplied to the pot burner 2 through the connecting pipe 10. The combustion is thus automatically converted from the above combustion mode completely into a vaporized gas combustion mode.

If the vaporized gas combustion is thus started, then air alone flows out from the connecting pipe 10. During this vaporized gas combustion, the air supplied through the ventilation openings 2*a* made in the pot burner 2 and through the connecting pipe 10 serves as a secondary air for the combustion at the burner 4.

Thus, this invention makes it possible to change from the diffusion combustion by the pot burner 2 to the vaporized gas combustion by the vaporized gas combustion burner 4, without requiring any special operation.

Figure 6:
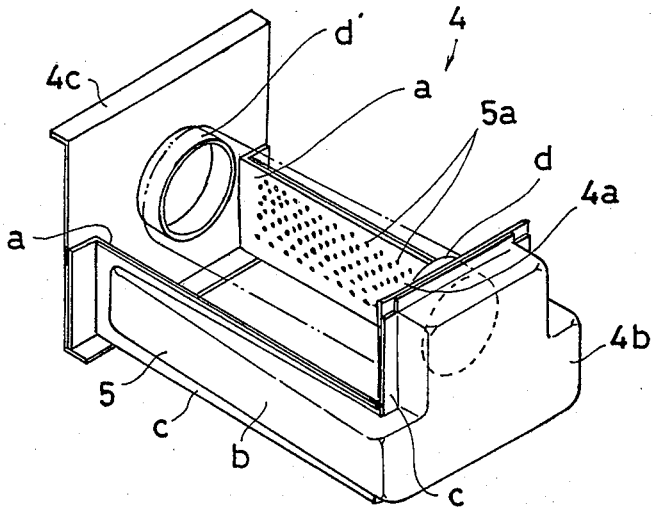
FIG. 6 is a perspective view of a vaporized gas combustion burner thereof.
Figure 7:
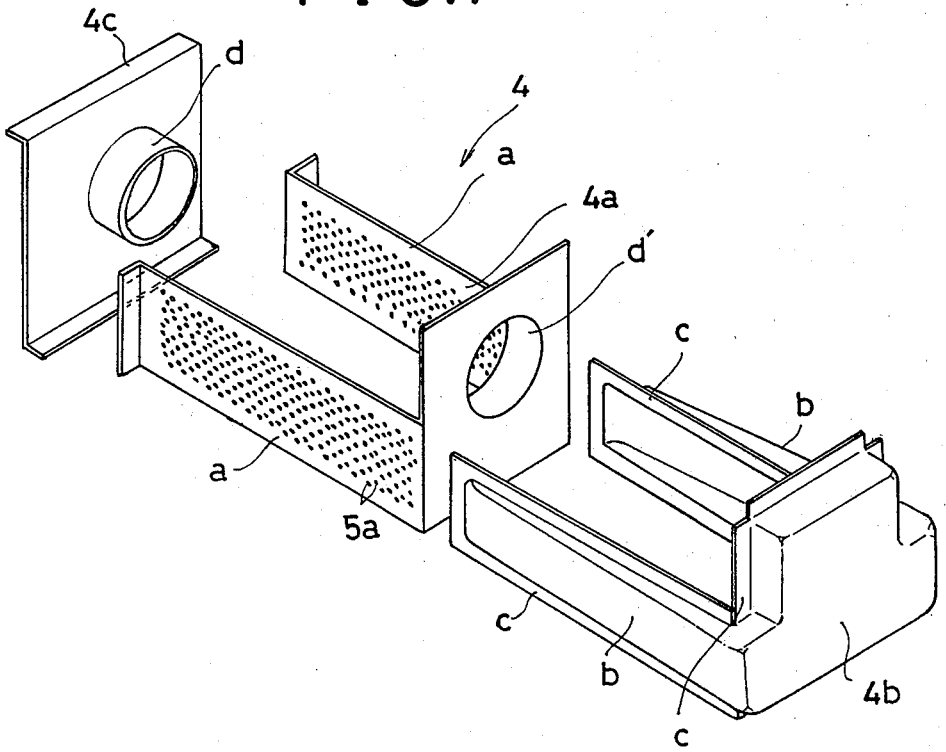
FIG. 7 is an exploded perspective view of the same.

The vaporized gas combustion burner 4 of the rectangular form as shown in FIG. 3 is constructed as shown in FIGS. 6 and 7. Namely, the burner 4 comprises an inner wall member 4*a* formed into an approximately U-shaped one by a press forming of a heat resistant metal sheet having a large number of flame openings 5*a* made in both side walls a, a thereof. An outer wall member 4*b* is formed into an approximately U-shaped one by a press forming of a heat resistant metal sheet having an outwardly swelled portion b and a peripheral margin for welding c. A closure plate 4*c* is also provided for closing an open end of the inner wall member 4*a*. The outer wall member 4*b* is put on the outer surface of the inner wall member 4*a* and seam-welded together at the welding margin c. Thus, the gas chamber 5 is formed therein. The closure plate 4*c* is attached, by welding, to the open end of the inner wall member 4*a*. The swelled portion b is in such a form that the swelled amount thereof is gradually decreased towards the open end of the outer wall member 4*b*. The closure plate 4*c* and an opposite end plate of the inner wall member 4*a* are provided with attachment openings d, d' for attaching the vaporizer 1 of the tubular form in an inclined fashion.

In this manner, the burner 4 can be manufactured very simply, and there can be obtained the long tubular burner producing flames uniformly over the entire length thereof.

In the case of the vaporizer 1 of the tubular form as shown in FIG. 3, a baffle plate 12 is provided therein, so that the interior of the vaporizer 1 is divided thereby into a vaporizing section 1*a* for vaporizing fuel and a mixing section 1*b* for mixing the vaporized fuel and air. In this case, the pot burner 2 is formed into a long one extending below and along the entire length of the vaporized gas combustion burner 4 of the rectangular form.

With the above arrangement, if fuel is supplied into the pot burner 2 by the connecting pipe 10 and is burned over the entire length of the bottom portion thereof, the entire length of the burner 4 is heated. Thus, vaporized gas resulting from vaporization of the liquid fuel by the heated portion 1*a* of the burner 4 is further heated by the heated portion 1*b* thereof and thereafter, is sent to the gas chamber 5. Consequently, such an unfavorable possibility of condensation of the vaporized gas in the gas chamber 5 is avoided.

The bottom portion of the pot burner 2 may be formed into an inclined one gradually lowering towards the ignition heater 3 side as shown in FIG. 3. This inclined pot burner 2 causes the fuel to tend to be collected in a lower end portion 2*b* of the pot burner near the ignition heater 3. Consequently, the combustion of the fuel by the pot burner 2 can be assured. Referring to the drawings, a stabilizer 13 is provided on the inlet side end portion of the vaporizer 1.

Figure 5:
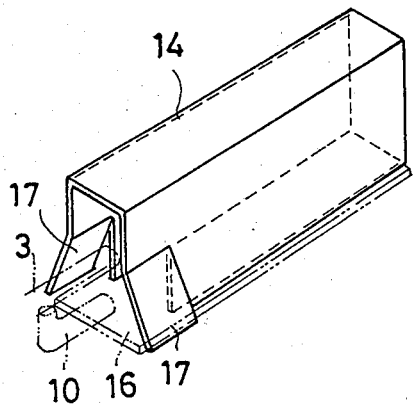
FIG. 5 is a perspective view of an upright plate thereof.

The pot burner 2 is provided with a large number of ventilation openings 2*a* made in both side walls along the longitudinal direction thereof, as shown in FIG. 3. In this case, it is possible that the forced air introduced through the mutually opposite ventilation openings 2*a* interferes one with another, so that the combustion in the pot burner 2 and that in the vaporized gas combustion burner 4 becomes unstable. For preventing this, an upright plate 14 as shown in FIG. 5 is placed at the center of the pot burner 2 so as to extend along the longitudinal direction thereof.

When this combustion apparatus is used at a very cold place (below −10° C.), the combustion by the pot burner 2 is often caused locally only at the place where the ignition heater 3 is located, so that it is difficult to cause a uniform heating of the entire length of the vaporizer 1. For preventing this, the ignition heater 3 is provided on one end of the pot burner 2, and at the same time the end portion thereof is provided with a ventilation opening 15 for generating an air current flowing along the upright plate 14, so that the entire uniform combustion at the pot burner 2 can be effected. If a long heat resistant cloth 16, such as of asbestos, is laid on the bottom surface of the pot burner 2 along the upright plate 14 so that the fuel supplied through the connecting pipe 10 to the pot burner 2 may be so introduced by the cloth 16 as to extend over the entire length of the pot burner 2, the above effect can be improved. A windbreak plate 17 is formed by partly cutting and bending upwards the lower end portions of the channel-formed upright plate 14. The same serves to prevent the heater 3 from being brought into contact with and cooled by the air entering from the openings 2*a*.

Figure 8:
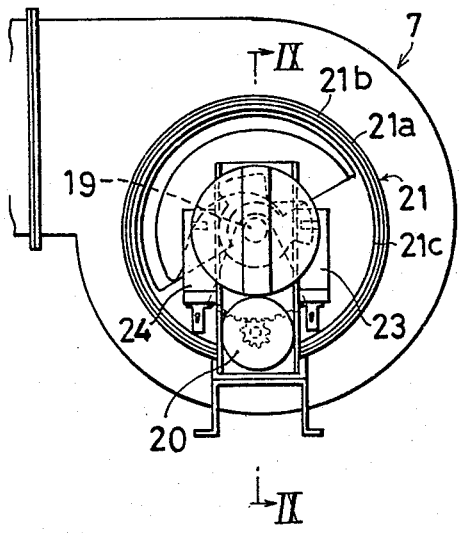
FIG. 8 is an enlarged side view of a blower section thereof.
Figure 9:
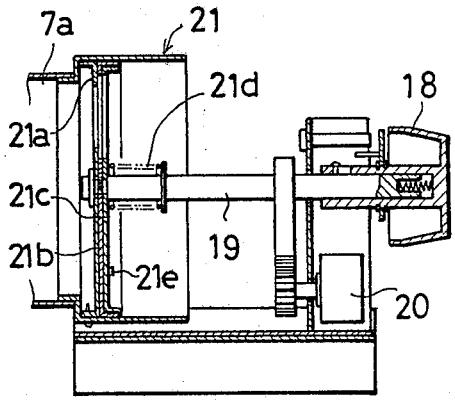
FIG. 9 is a sectional view taken along the line IX—IX in FIG. 8.
Figure 10:
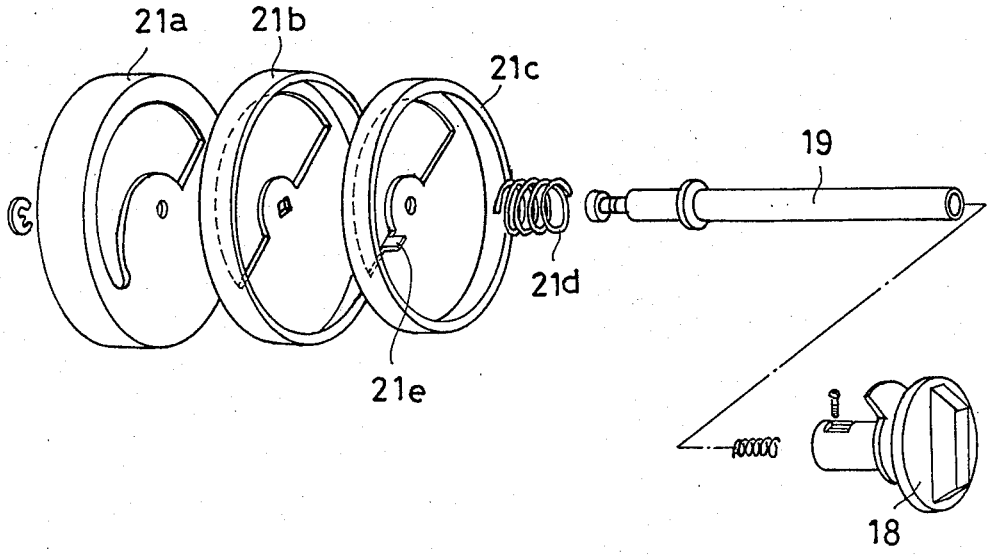
FIG. 10 is an exploded perspective view of an air amount adjusting device thereof.

In the illustrated example, the apparatus is so arranged that the electromagnetic pump 11 can be adjusted in delivery amount of liquid for adjusting the combustion degree thereof. The air amount introduced from the blower 7 can be also adjusted in accordance therewith. A detailed construction thereof is shown in FIGS. 8 and 9. Namely, there is provided a frequency changing device 20 for changing the frequency of the electromagnetic pump 11 in conjunction with operation of an operation shaft 19 having an adjusting knob 18. An air amount adjusting device 21 is provided on an inlet opening 7*a* side of the blower 7, and is connected to the operation shaft 19 in order to be adjusted thereby. The air amount adjusting device 21 comprises an air amount throttle plate 21*a* fixed to the inlet opening 7*b*, a movable air amount throttle plate 21*b* put thereon, and a throttle amount adjusting plate 21*c* which is movable with the air amount throttle plate 21*b*. These are provided on the foregoing operation shaft 19 as shown in FIGS. 8 to 10 so that adjusting of the air amount is also carried out by the adjusting knob 18 on the operation shaft 19. More in detail, the air amount throttle plate 21*b* is so attached to the operation shaft 19 as to be movable therewith, and the throttle degree adjusting plate 21*c* is mounted rotatably on the shaft 19 and at the same time is pushed against the air amount throttle plate 21*b* by a spring 21*d*. An adjusting tab 21*e* is formed by cutting and bending of part of the throttle degree adjusting plate 21*c*.

With this arrangement, the fuel supply amount can be adjusted while a predetermined relationship between the fuel amount and the air amount is being maintained. Additionally, the throttle degree of the air amount throttle plate 21*b* can be adjusted by the throttle degree adjusting plate 21*c*, and thereby a variation of the air amount caused by a fluctuation of the revolution speed of the blower can be removed.

Additionally, the adjusting knob 18 is so provided on the operation shaft 19 as to be axially movable. An ignition switch 23 is provided behind and in opposite to such a rotary angular position of the adjusting knob 18 that the fuel supply amount becomes maximum. An extinguishing switch 24 is provided behind and at such a rotary angular position of the adjusting knob 18 that the fuel supply amount becomes minimum.

With this arrangement ignition can be effected with the fuel supply amount always at the maximum position. Accordingly, the vaporizer 1 can be heated to a predetermined temperature by the combustion by the pot burner 2 as soon as possible after the ignition. The combustion in the pot burner 2 can then be converted to that by the vaporized gas combustion burner 4 as soon as possible.

Figure 11:
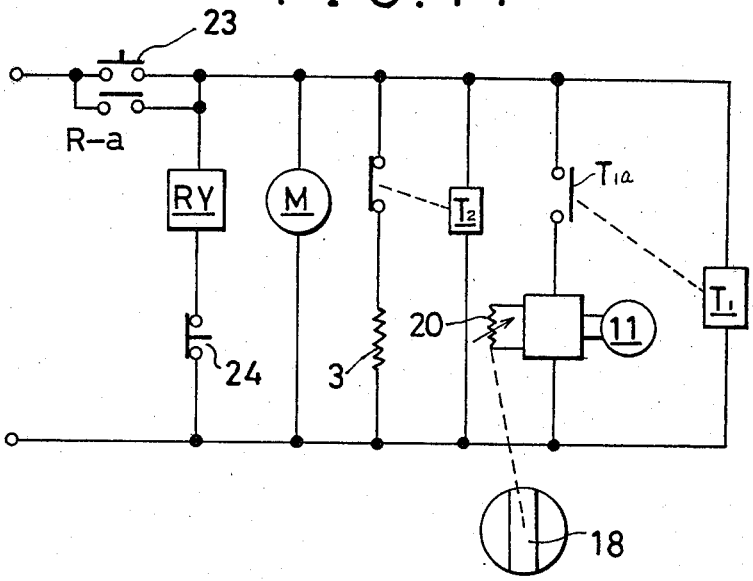
FIG. 11 is a diagram showing a control circuit.

FIG. 11 shows one example of a control circuit having the ignition switch 23 and the extinguishing switch 24. The circuit comprises the ignition switch 23 arranged to be closed by pushing of the adjusting knob 18, a relay coil RY arranged to be energized by closing of the ignition switch 23, a reply contact R-*a* of the relay coil RY, the extinguishing switch 24 connected in series with the relay coil RY, an electric motor M for driving the blower 7, the ignition heater 3, the frequency changing device 20 for the pump 11, and first and second timers T1, T2. If, with this circuit, the adjusting knob 18 is pushed to close the ignition switch 23, the relay coil RY is energized to close the relay contact R-*a*. Thus, the control circuit becomes operative, and the ignition heater 3 is energized and the motor M is driven. After the lapse of a predetermined amount of time, the timer T1 operates to close a contact T1*a* interposed in the electric pump 11 circuit. Thus, the pot burner 2 is supplied with fuel through the fuel supply pipe 9 and the connecting pipe 10. As a result, the combustion by the pot burner 2 is started. The timer T2 then operates after a second predetermined time period to cut off the heater 3. Thereafter, the foregoing combustion by the vaporizer 4 results. For stopping combustion, the adjusting knob 18 is turned to its fuel supply amount minimum position and is pushed. The relay coil RY is thereby de-energized by the opening of switch 24, and the contact R-*a* thereof is opened. As a result, the circuit is cut off to become inoperative.

If, as shown in FIG. 3, the connecting pipe 10 is separately prepared having an upper connecting pipe 10*a* connected to the vaporizer 1 side and a lower connecting pipe 10*b* connected to the pot burner 2 side, it is convenient that a duct 26 connected to the blower 7 is put on the upper surface of a fuel tank 25, and the pot burner 2 is mounted in an opening 26*a* made in the upper surface of the duct 26. The vaporized gas combustion burner combined with the vaporizer 1 and the fuel supply pipe 9 is put on the pot burner 2 and these members are fixed together by a fixing means such as a spring 27 or the like.

The lower connecting pipe 10*b* can be provided with a fuel reservoir 10*b*-1 and a feedback pipe 10*b*-2 for returning the excessive fuel in the reservoir 10*b*-1 to the tank 25. A conduit portion between the reservoir 10*b*-1 and the pot burner 2 is provided with an orifice 10*b*-3 interposed therein, so that the fuel supplied to the pot burner 2 is kept always constant in amount.

Figure 12:
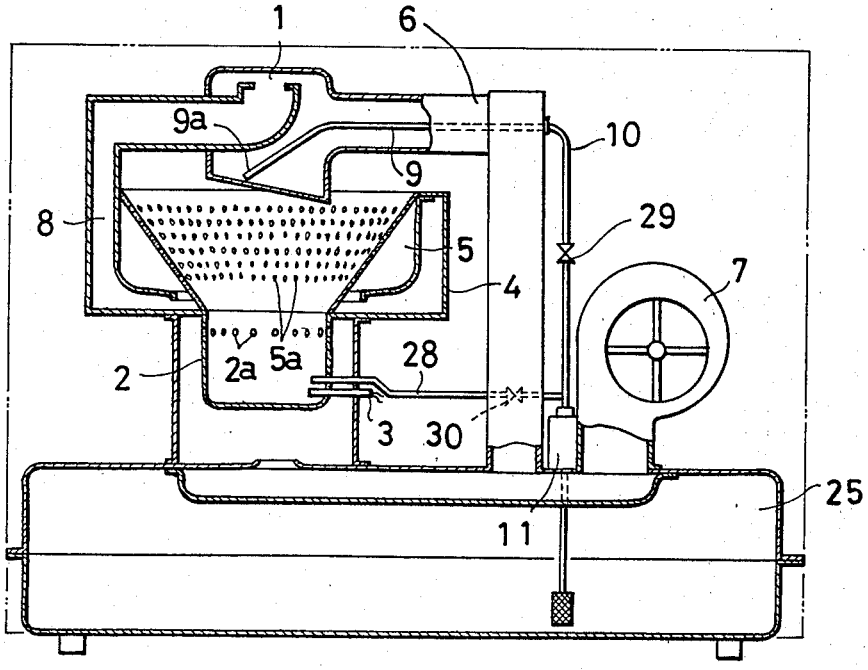
FIG. 12 is a sectional side view of further another embodiment of this invention apparatus.

A third embodiment is shown in FIG. 12, wherein the pot burner 2 is supplied directly with fuel by another fuel supply pipe 28 diverged from the fuel supply pipe 10 connected to the vaporizer 1. In this case, electromagnetic valves 29, 30 are interposed in the respective fuel supply pipes 10, 28, and these are controlled by a timer or the like. Thus, fuel is supplied first to the pot burner 2 so that it may be burned at the burner 2 for heating the vaporizer 1. When the vaporizer 1 is heated to a predetermined temperature, fuel is then supplied to the vaporizer 1 in order to be vaporized and burned at the burner 4. Thereafter, the supply of fuel to the pot burner 2 is cut off. By this way, almost the same operation as the foregoing examples can be obtained.

Thus, according to this invention, since the vaporizer for vaporizing liquid fuel is heated by the diffusion combustion in the pot burner, the vaporizer is heated to a desired temperature, and the fuel is vaporized by the vaporizer and is supplied to the vaporized gas combustion burner so that the vaporized gas combustion by the burner is established. Thereafter, the vaporizer can be continued to be heated by the vaporized gas combustion by that burner. Consequently, a comparatively large electric heater is not required to be operated during combustion operation. Further, this invention apparatus is simpler in construction than the conventional one requiring rotary members such as a rotary type vaporizer.

Furthermore, especially by such an arrangement that the bottom portion of the vaporizer is formed into the inclined one, and the fuel supply pipe is located on the upper end side thereof and the lower end side thereof is in communication with the pot burner through the connecting pipe, it is made possible that in an initial condition that the vaporizer is not heated to a predetermined temperature, the fuel supplied to the vaporizer is supplied through the connecting pipe to the pot burner. If the vaporizer is heated to that temperature, the fuel is vaporized by the vaporizer and the vaporized gas combustion by the burner results, so that conversion from the diffusion combustion to the vaporized gas combustion can be made smoothly and automatically.

What is claimed is:

1. A vaporizing type liquid fuel combustion apparatus comprising a pot burner, vaporizer means for vaporizing liquid fuel provided above the pot burner, a fuel supply pipe for supplying the liquid fuel to the vaporizer means, a vaporized gas combustion burner which has a gas chamber connected to the vaporizer means and which is arranged to heat the vaporizer means, and means including a blower for supplying air to the pot burner and to the vaporizer means.

2. An apparatus as claimed in claim 1, wherein the vaporizer means has a bottom portion formed as an inclined surface inclined in one direction having in upper end side and a lower end side, and the liquid fuel supply pipe is arranged to open on the upper end side of the inclined surface; and the lower end side of the inclined surface and the pot burner are in communication one with another through a connecting pipe.

3. An apparatus as claimed in claim 2, wherein the pot burner is circular in form, and the vaporizer means is a drum in form, and the vaporized gas combustion burner is circular annular in form.

4. An apparatus as claimed in claim 2, wherein the pot burner is rectangular in form, the vaporizer means is long tubular in form, and the vaporized gas combustion burner is rectangular in form.

5. An apparatus as claimed in claim 4, wherein the vaporized gas combustion burner comprises an inner wall member formed into an approximately U-shaped frame by a press forming of a heat resistant metal sheet having a large number of flame openings made in both side walls thereof, an outer wall member formed into an approximately U-shaped frame by a press forming of a heat resistant metal sheet having a swelled portion and a peripheral margin for welding, and a closure plate attached to an open end of the inner wall member; said outer wall member being put on the outer surface of said inner wall member and seam-welded together, said swelled portion being gradually decreased in its swelled amount towards the open end thereof, and said closure plate and an opposite end plate of the inner wall member are provided with attaching openings for attaching the vaporizer means.

6. An apparatus as claimed in claim 4, wherein the vaporizer means is divided in its interior by a baffle plate into a vaporizing section for vaporizing the fuel and a mixing section, and the bottom portion of the pot burner is inclined so that fuel may be gathered on an ignition heater side of the pot burner.

7. An apparatus as claimed in claim 4, wherein the connecting pipe is provided with a feedback pipe for returning part of the fuel.

8. An apparatus as claimed in claim 4, wherein the pot burner is provided with ventilation openings made in both side walls thereof, and is provided at its center with an upright plate extending in the longitudinal direction thereof, and a fuel supply opening and an ignition heater are exposed to face one end portion of the upright plate, and windbreak members are provided on both sides of the ignition heater, and the pot burner is provided at its end portion with a ventilation opening for generating an air current flowing along the upright plate.

9. An apparatus as claimed in claim 4, further comprising a fuel supply amount adjusting knob, and an inlet opening of the blower is provided with a stationary air amount throttle plate, means including a movable air amount throttle plate put thereon and arranged to be rotatable with the rotation of the adjusting knob, and a throttle amount adjusting plate means arranged to be rotatable with the rotation of the air amount throttle plate.

10. An apparatus as claimed in claim 9, wherein the adjusting knob is axially movable on an operation shaft and an ignition switch is provided behind and in opposition to a fuel supply amount maximum rotary angular position of the adjusting knob, and an extinguishing switch is provided behind and in opposition to a fuel supply amount minimum rotary angular position of the knob.

11. An apparatus as claimed in claim 1, wherein the fuel supply pipe is provided with a diverged passage for supplying fuel directly to the pot burner, and the fuel supply pipe and the diverged passage are provided with respective electromagnetic valves interposed therein.

* * * * *